US009517473B2

(12) United States Patent
Marchand et al.

(10) Patent No.: US 9,517,473 B2
(45) Date of Patent: Dec. 13, 2016

(54) MAGNETIC FILTER FOR A FLUID PORT

(71) Applicant: Bay6 Solutions Inc., St. Albert (CA)

(72) Inventors: Roger L. Marchand, St. Albert (CA); Douglas J. Tschetter, St. Albert (CA)

(73) Assignee: Bay6 Solutions Inc., St. Albert, Alberta (CA)

( * ) Notice: Subject to any disclaimer, the term of this patent is extended or adjusted under 35 U.S.C. 154(b) by 521 days.

(21) Appl. No.: 14/091,886

(22) Filed: Nov. 27, 2013

(65) Prior Publication Data

US 2014/0144827 A1 May 29, 2014

Related U.S. Application Data

(60) Provisional application No. 61/730,180, filed on Nov. 27, 2012.

(51) Int. Cl.
*B03C 1/033* (2006.01)
*B03C 1/28* (2006.01)

(52) U.S. Cl.
CPC ..... *B03C 1/0332* (2013.01); *B03C 1/286* (2013.01); *B03C 2201/18* (2013.01); *Y10T 29/49817* (2015.01)

(58) Field of Classification Search
CPC .... B03C 1/0332; B03C 1/286; B03C 2201/18; Y10T 29/49817
See application file for complete search history.

(56) References Cited

U.S. PATENT DOCUMENTS 3,286,841 A 11/1966 Dinglinger
3,355,024 A 11/1967 Skoyles et al.
4,750,998 A 6/1988 Nakamur
4,946,589 A 8/1990 Hayes
6,143,171 A 11/2000 Van Aarsen
6,270,667 B1 * 8/2001 Nakamura ..... B01D 35/06 184/6.25
6,649,054 B2 11/2003 Iida et al.
(Continued)

FOREIGN PATENT DOCUMENTS

CA 2331559 A1 7/2002
JP 58143814 A 8/1983

OTHER PUBLICATIONS

Magnetool—Magnetic fluid Line Filters, URL=www.magnetoolinc.com/filters/fluid-line-filters.php, accessed on Sep. 5, 2013, 2 pages.

*Primary Examiner* — David A Reifsnyder
(74) *Attorney, Agent, or Firm* — Davis & Bujold PLLC; Michael J. Bujold

(57) ABSTRACT

A magnetic filter includes a stack of magnetic filter elements having a central flow channel comprising at least one flow opening in the magnetic filter elements and a series of flow gaps between adjacent magnetic filter elements, each magnetic filter element comprising one or more magnets enclosed within a non-magnetic housing. There is an end cap at a second end of the stack of magnetic filter elements, the end cap closing the central flow channel at the second end such that flow is redirected in parallel flows through the flow gaps between the magnetic filter elements. There is an attachment at a second end of the stack of magnetic filter elements, the attachment attaching the stack of magnetic filter elements to a fluid port of a fluid system to define a flow path between the fluid port and the outer fluid environment.

34 Claims, 14 Drawing Sheets

(56) References Cited

U.S. PATENT DOCUMENTS

| | | | |
|---|---|---|---|
| 6,706,178 | B2 | 3/2004 | Simonson |
| 6,833,069 | B1 | 12/2004 | Asterlin |
| 6,835,308 | B2 | 12/2004 | Elsegood |
| 7,427,352 | B2 | 9/2008 | Naito |
| 7,604,748 | B2 | 10/2009 | Newman et al. |
| 2011/0094956 | A1 | 4/2011 | Marchand et al. |
| 2012/0135494 | A1 | 5/2012 | Murthy et al. |
| 2013/0105379 | A1 | 5/2013 | Lee |

* cited by examiner

MAGNETIC FILTER FOR A FLUID PORT

FIELD

This relates to a magnetic filter for a fluid port

BACKGROUND

In some fluid systems, such as hydraulic motor fluid systems, it is necessary to remove ferrous particles to prevent or reduce the damage to components in the fluid system. Magnetic filter elements have been designed to be introduced into the flow stream to help remove these ferrous particles. United States pre-grant publication no. 2011/0094956 (Marchand et al) entitled "Filter Elements" and U.S. Pat. No. 6,706,178 (Simonson) entitled "Magnetic Filter and Magnetic Filtering Assembly" are two examples of magnetic filter elements.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
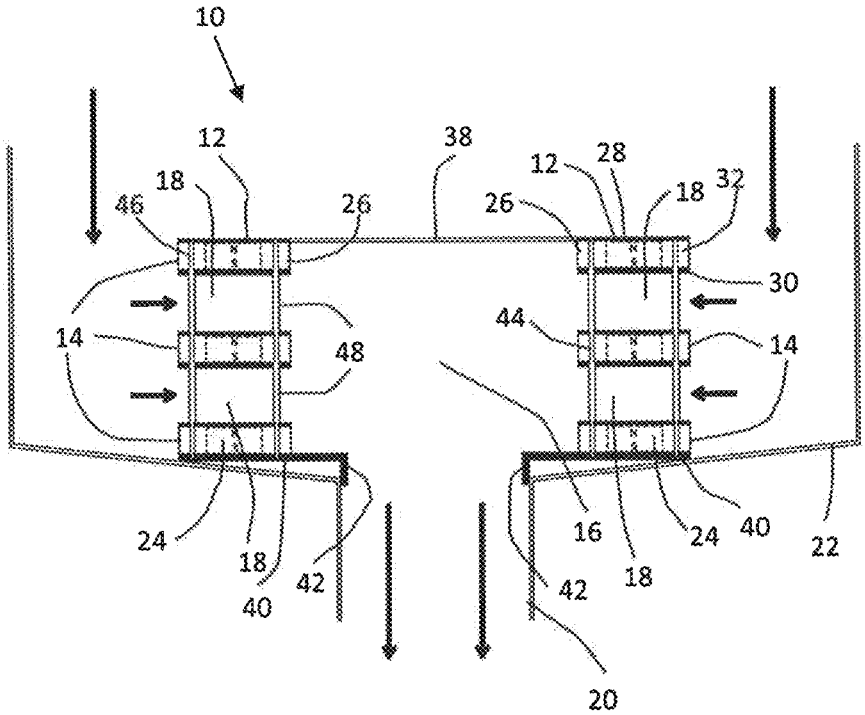
FIG. 1 is a side elevation view in section of a magnetic filter element.

Referring to FIG. 1, there is shown a magnetic filter 10, comprising a stack 12 of magnetic filter elements 14 having a central flow channel 16 through stack 12. Central flow channel 16 is made up of a series of flow openings 17 (shown in FIG. 5) in magnetic filter elements 14 that form the stack. The number of magnetic filter elements 14 and the number of flow openings 17 may vary. Magnetic filter 10 also has a series of flow gaps 18 between adjacent magnetic filter elements 14. As shown, central flow channel 16 is aligned with a flow port 20 of a fluid system, which may be considered an outer fluid environment relative to magnetic filter 10. For example, as shown, fluid port 20 is communicating with a fluid reservoir 22, and fluid may be flowing through fluid port 20 in either direction relative to fluid reservoir 22. In addition to the depicted fluid reservoir 22, magnetic filter 10 may be positioned within a pipe, for example, within an oversized section of pipe that allows fluid to flow between the outside and the inside of filter 10 as described below, without an undue restriction of flow. Filter 10 may also be installed in other areas where it is desired to filter a fluid flow.

Figure 2:
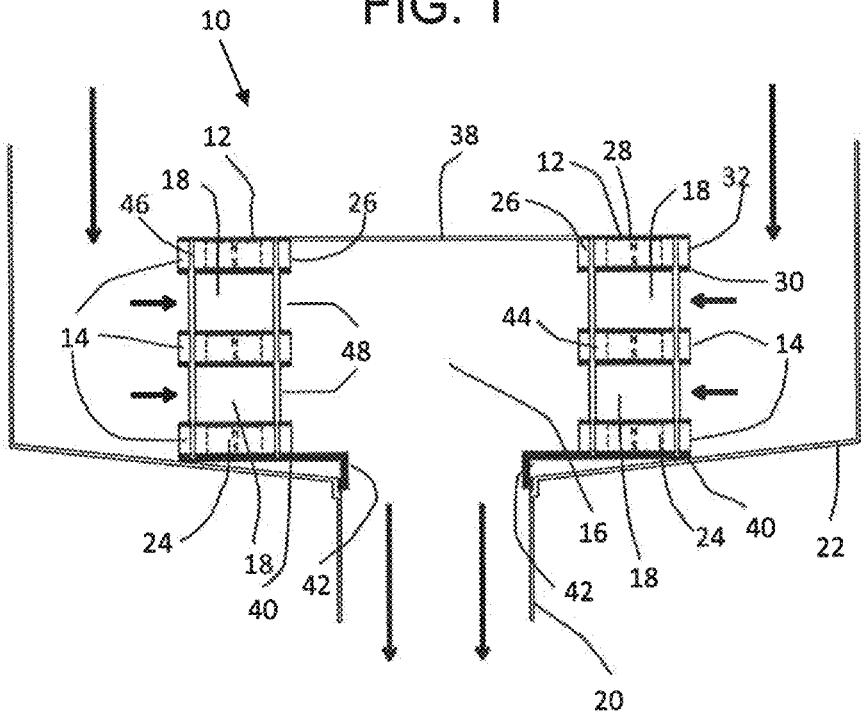
FIG. 2 through 4 are side elevation views in section of magnetic filter elements with alternative attachments.
Figure 5:
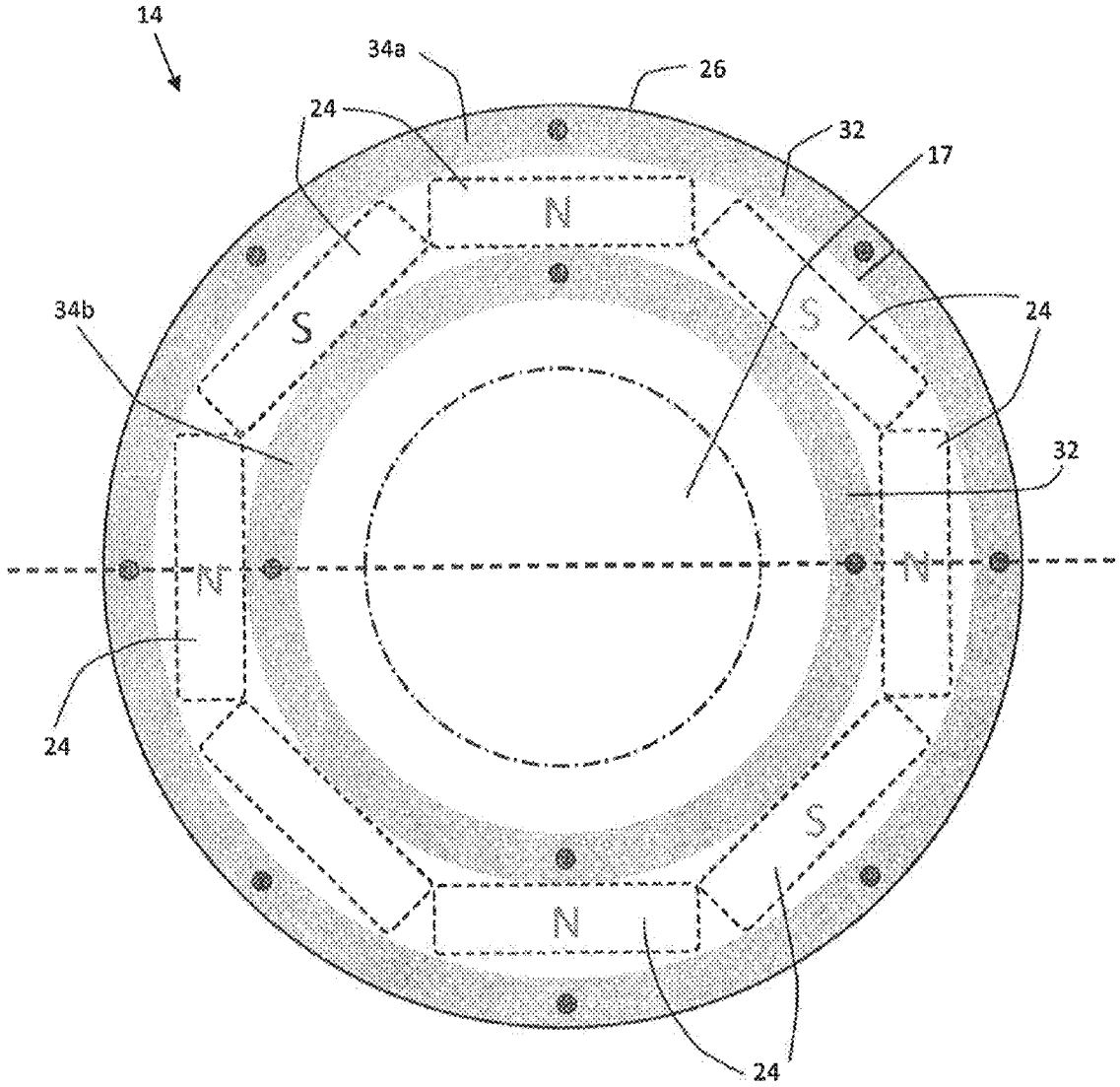
FIG. 5 through 7 are top plan views of magnetic filter elements without a top plate.
Figure 6:
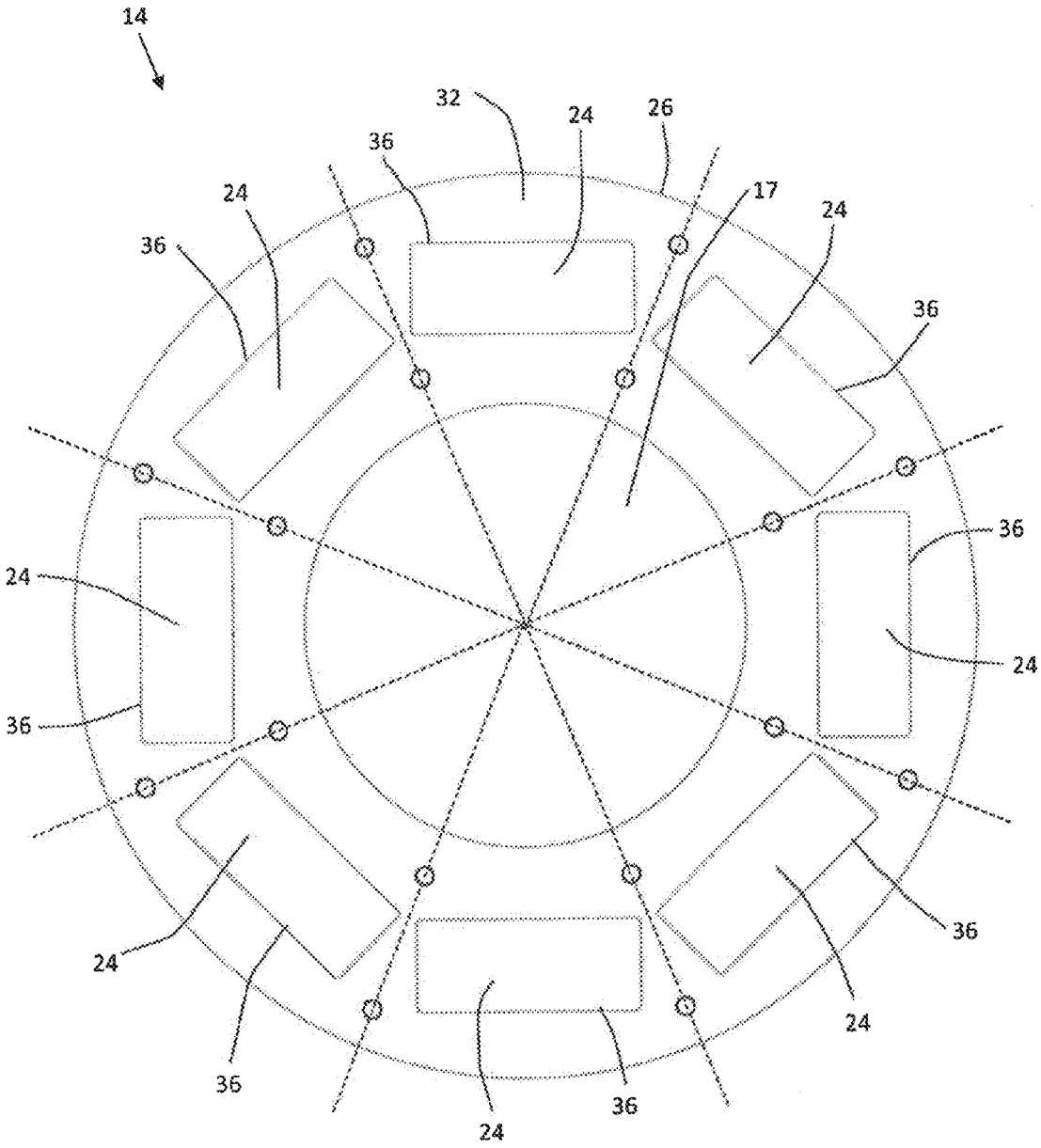
Figure 7:
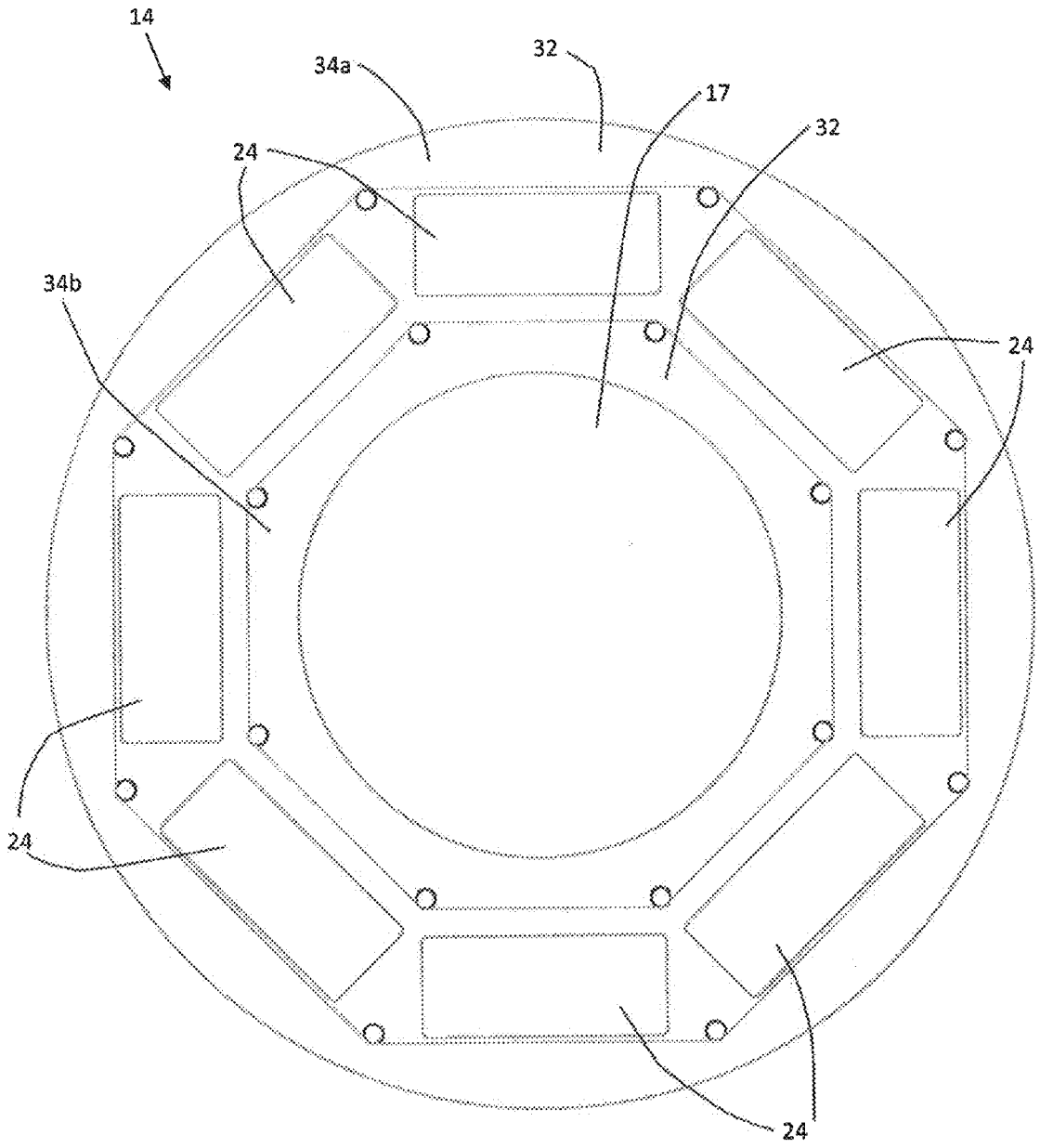

Referring to FIGS. 1 and 2, each magnetic filter element 14 is made up of one or more magnets 24 enclosed within a non-magnetic housing 26 around the corresponding flow opening 17. Non-magnetic housing 26 isolates magnets 24 from the outer fluid environment, such that they do not come into contact with the fluid. In one example, housing 26 is made from a non-ferrous material, such as aluminium, stainless steel, etc. Other materials may also be used, including non-metals, as will be recognized by those skilled in the art. In the depicted example, housing 26 is made up of a top plate 28, a bottom plate 30, and a spacer element 32. Spacer element 32 may be inner and outer rings 34*a* and 34*b* as shown in FIGS. 5 and 7, where FIG. 5 shows round rings 34*a* and 34*b* while FIG. 7 shows profiled rings that accommodate the size of magnets 24. Alternatively, referring to FIG. 6, spacer element 32 may be a single component with cavities 36 shaped to receive magnets 24. Other variations will be apparent to those skilled in the art. For example, magnets 24 may be individually housed, rather than housed in a single element. Magnets 24 are designed to be the same height or smaller than spacer element 32, such that, when housing 26 is assembled, magnets 24 are enclosed and isolated within housing 26. It has been found that a thinner magnetic filter element 14 is preferable to a thicker filter element 14, with a higher surface area to volume ratio.

Figure 8:
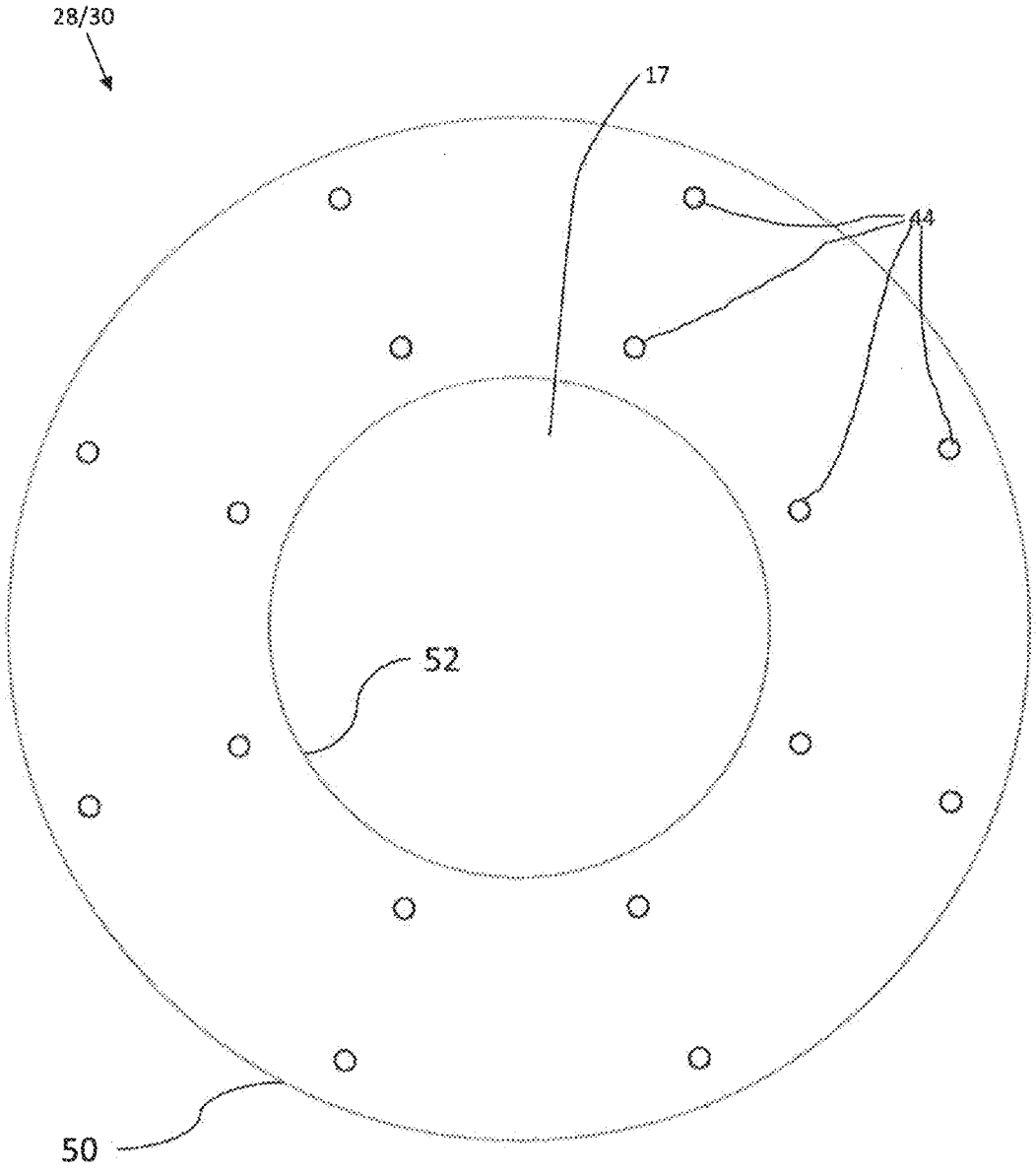
FIG. 8 is a top plan view of a top or bottom plate of a magnetic filter element.
Figure 14:
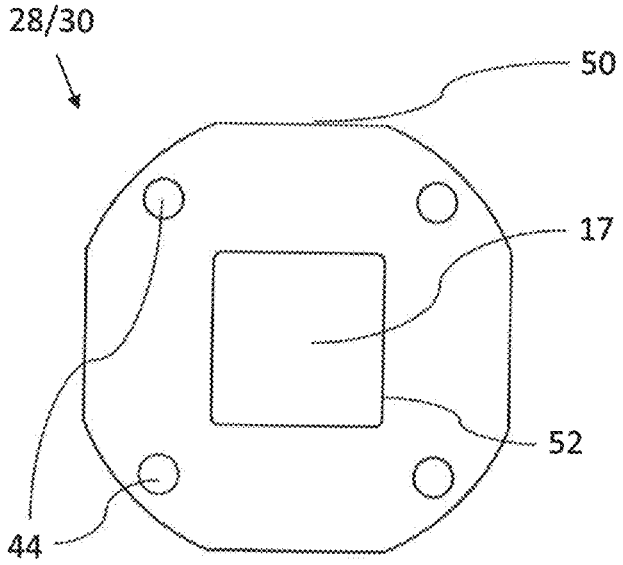
FIG. 14 through 16 are top plan views of a top or bottom plate of a magnetic filter element shown with various internal and external geometries.
Figure 15:
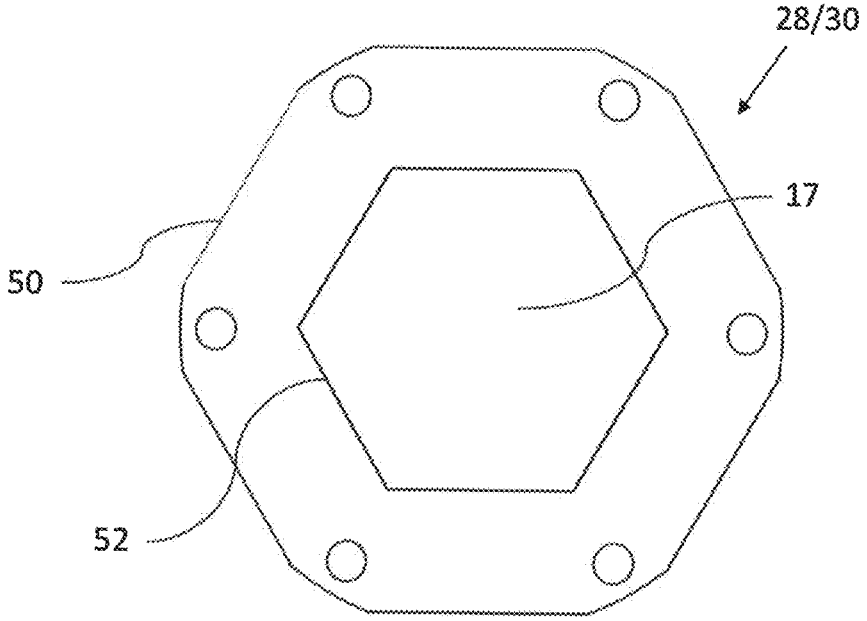
Figure 16:
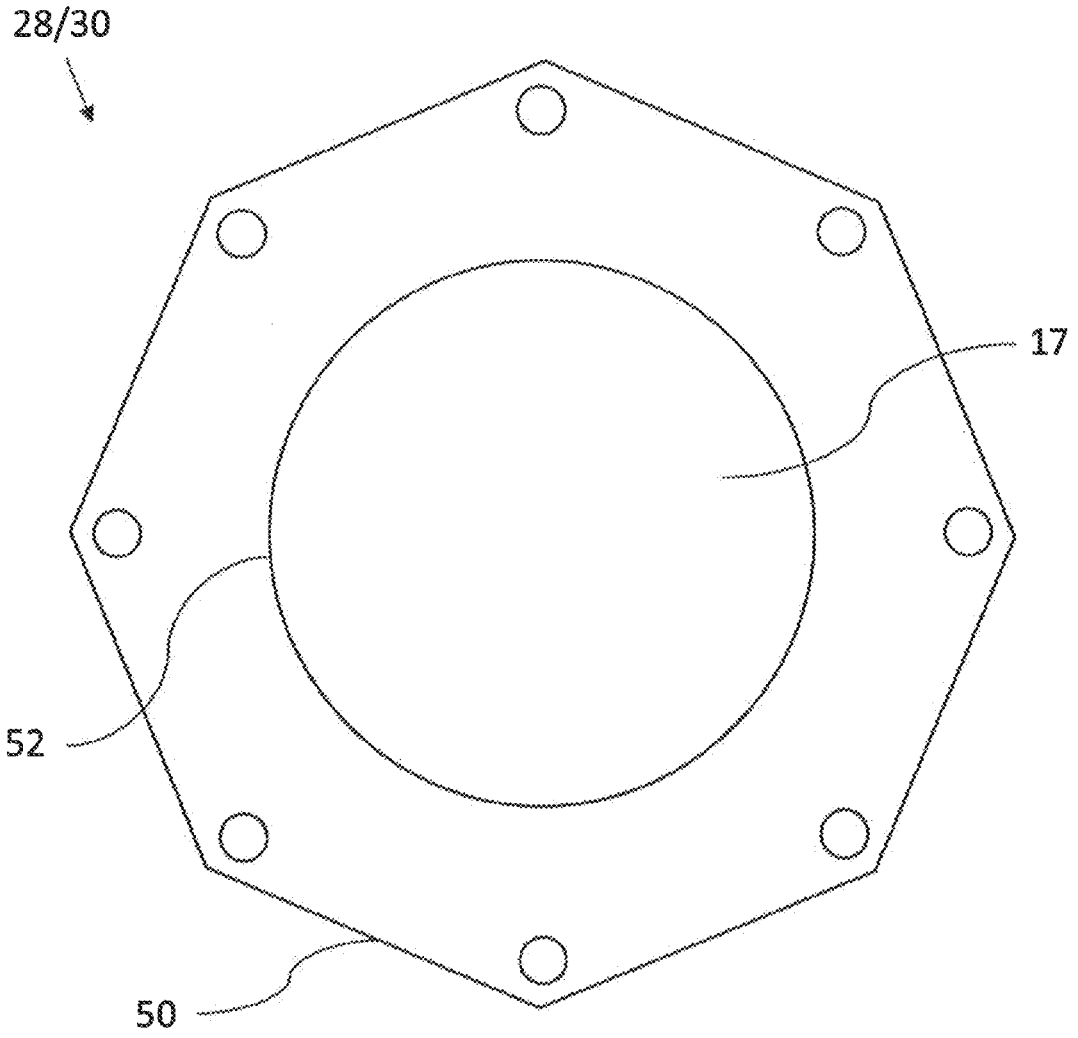

Referring to FIG. 8, the top plate 28 or bottom plate 30 of the magnetic filter element 14 making up housing 26 and defining flow opening 17 has apertures 44 through which pin connectors 46 are inserted. Referring to FIG. 14 through FIG. 16, it will be appreciated that the outer perimeter 50 and the inner perimeter 52 defining flow opening 17 may each have varying geometries to accommodate for different placements and needs, and that the geometries are not limited to those shown in the drawings, as many combinations of outer and inner perimeter geometries may be used.

It will be understood that various designs for housing 26 may be used. However, the versions of housing 26 depicted in the drawings have the benefit of being made from metal, and may be made using a die stamp and press. It will also be understood that the shape and number of magnets 24 may also have a bearing on the size and shape of spacer element 32, or housing 26 as a whole. In the depicted example, magnets 24 are rectangular prisms and multiple magnets 24 are used, and are equally spaced within housing 26 around flow opening 17. For example, there are eight magnets of equal size positioned within housing 26. As magnets can be formed in many different shapes and sizes, and may be curved, the actual configuration of housing 26 may be varied by those skilled in the art to suit the circumstances. It will also be understood that the polarity of magnets 24 may also vary, depending on the magnetic field that a user desires to apply to a flow stream.

Figure 9:
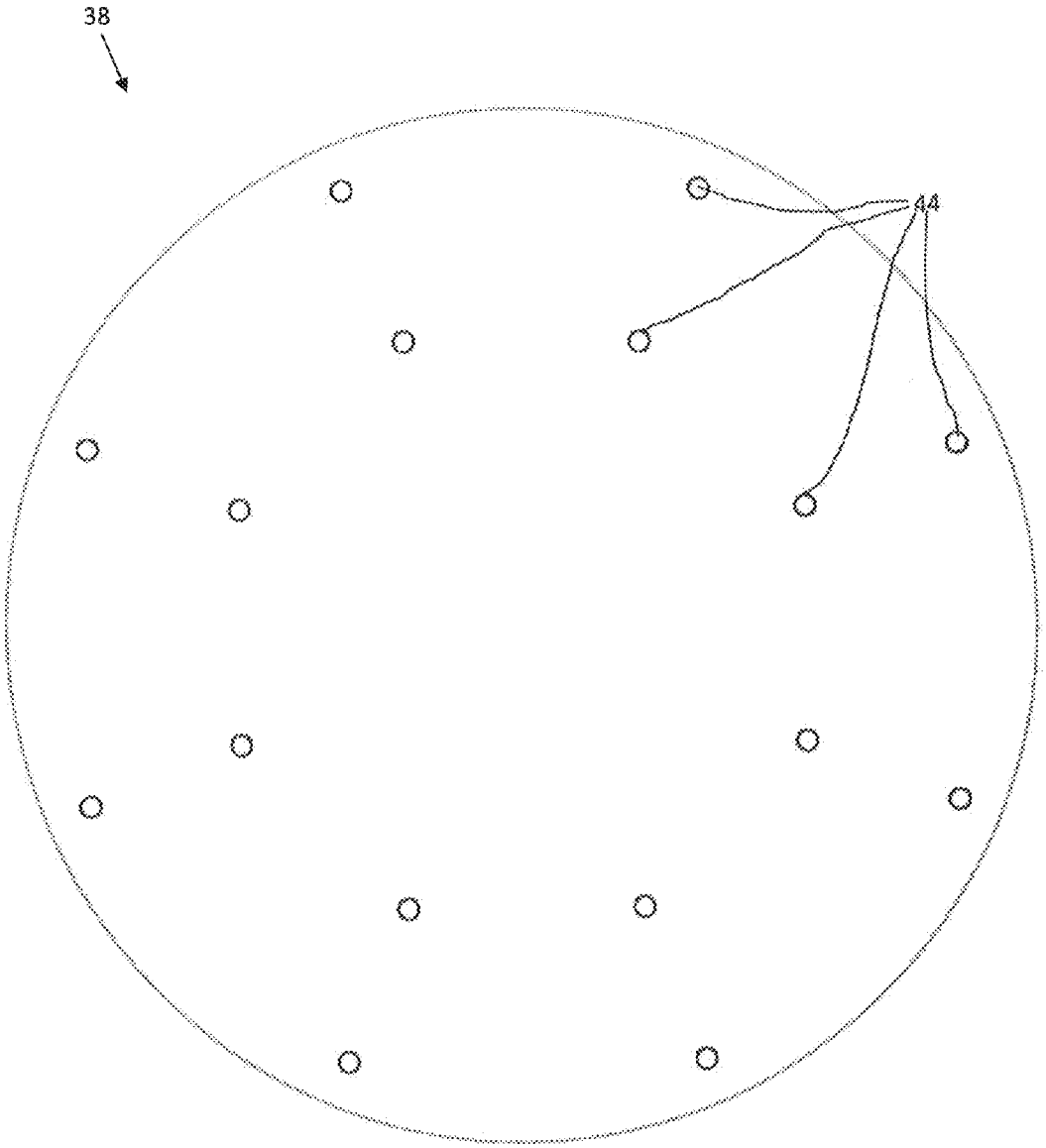
FIG. 9 is a top plan view of an end cap for a magnetic filter element.

Referring to FIGS. 1 and 9, an end cap 38 is positioned at the top of stack 12. As shown, end cap 38 is part of a filter element 14, where the top plate 28 has been replaced by a solid disk instead. This modified filter element 14 is placed at the top of stack 12 to force fluid flow to pass through flow gaps 18. By using a modified filter element, magnets 24 are placed above the adjacent flow gap 18. Alternatively, end plate 38 may not carry magnets. In that case, it may be preferable to make the adjacent flow gap smaller as there will be less of a magnetic field applied in that area.

Figure 3:
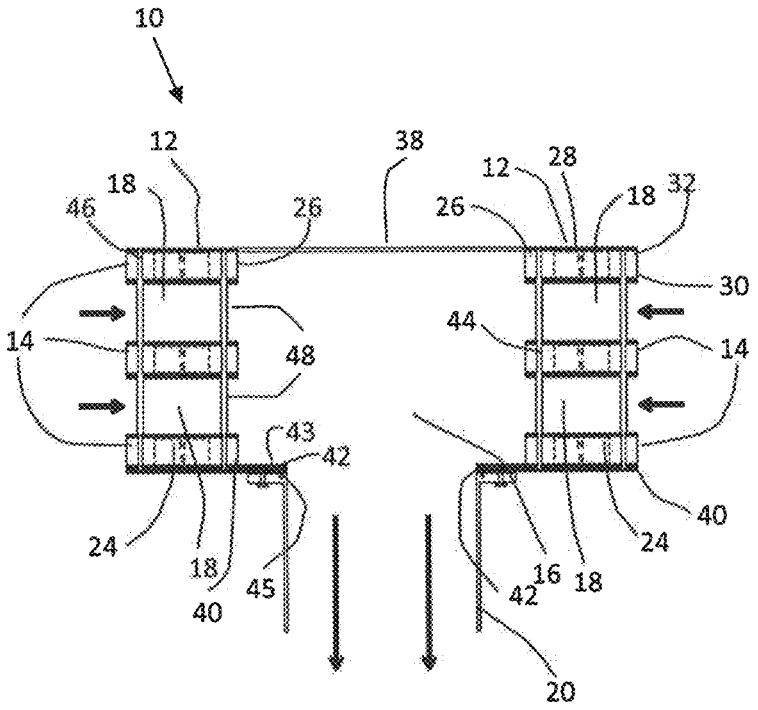
Figure 4:
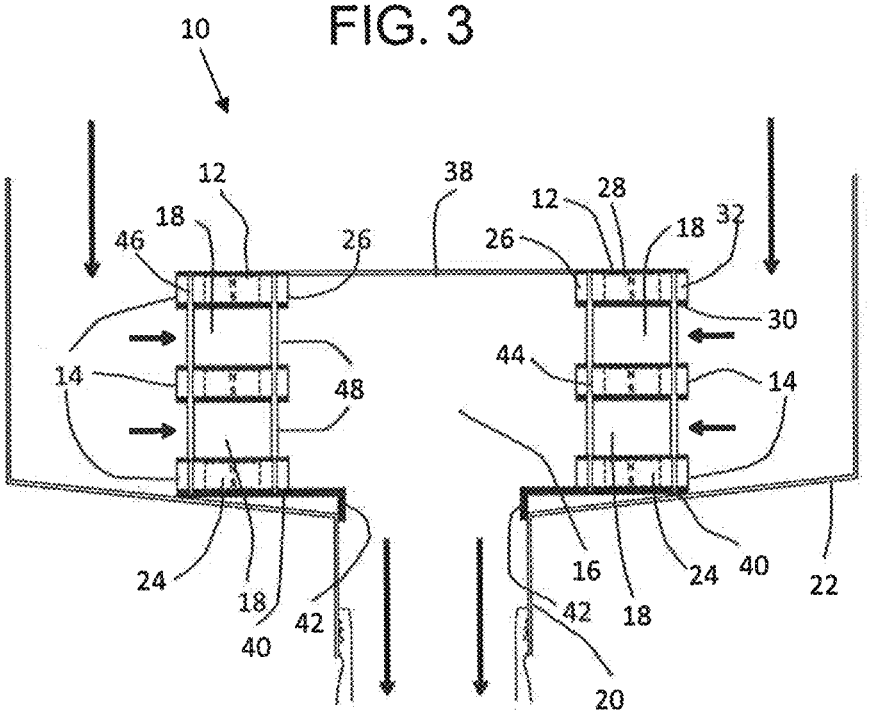

Also referring to FIG. 1, an attachment 40 is also included at the bottom of stack 12. As with end cap 38, attachment 40 is preferably included as a component in a modified filter element 14. Attachment 40 is used to secure magnetic filter 10 in place. When installed in a ferrous tank, magnets 24 may also act as part of attachment 40 to hold magnetic filter 10 in place. Attachment 40 may have a central flange 42 that helps align magnetic filter 10 with flow port 20 and create a seal if necessary. The seal may not be a fluid tight seal, but should be sufficient to ensure that only a very small amount of seepage is permitted around magnetic filter 10 during use. Alternatively, some flow may be permitted around the bottom of magnetic filter 10, such that the space between the bottom filter element 14 and the reservoir wall 22 may be considered a flow gap 18 as well. In a further alternative, attachment 40 may be a cylindrical, threaded connection that screws into a fitting in fluid port 20, as shown in FIG. 2. In a further alternative, attachment 40 may be connected directly to fluid port 20, which may extend a certain distance into fluid reservoir 22, as shown in FIG. 3. In the depicted example, fluid port 20 is a pipe with a flange 43 that may have an O-ring seal 45. Other types of attachment may also be used. Fluid port 20 may extend in any direction, such as extending down or up into the fluid reservoir, or laterally. Referring to FIG. 4, in another alternative, stack 12 may be permanently installed in a container, such that it may be installed as an inline filter. In this example, attachment 40 may not be located at the bottom of stack 12, but may be attached at any convenient location.

Figure 10:
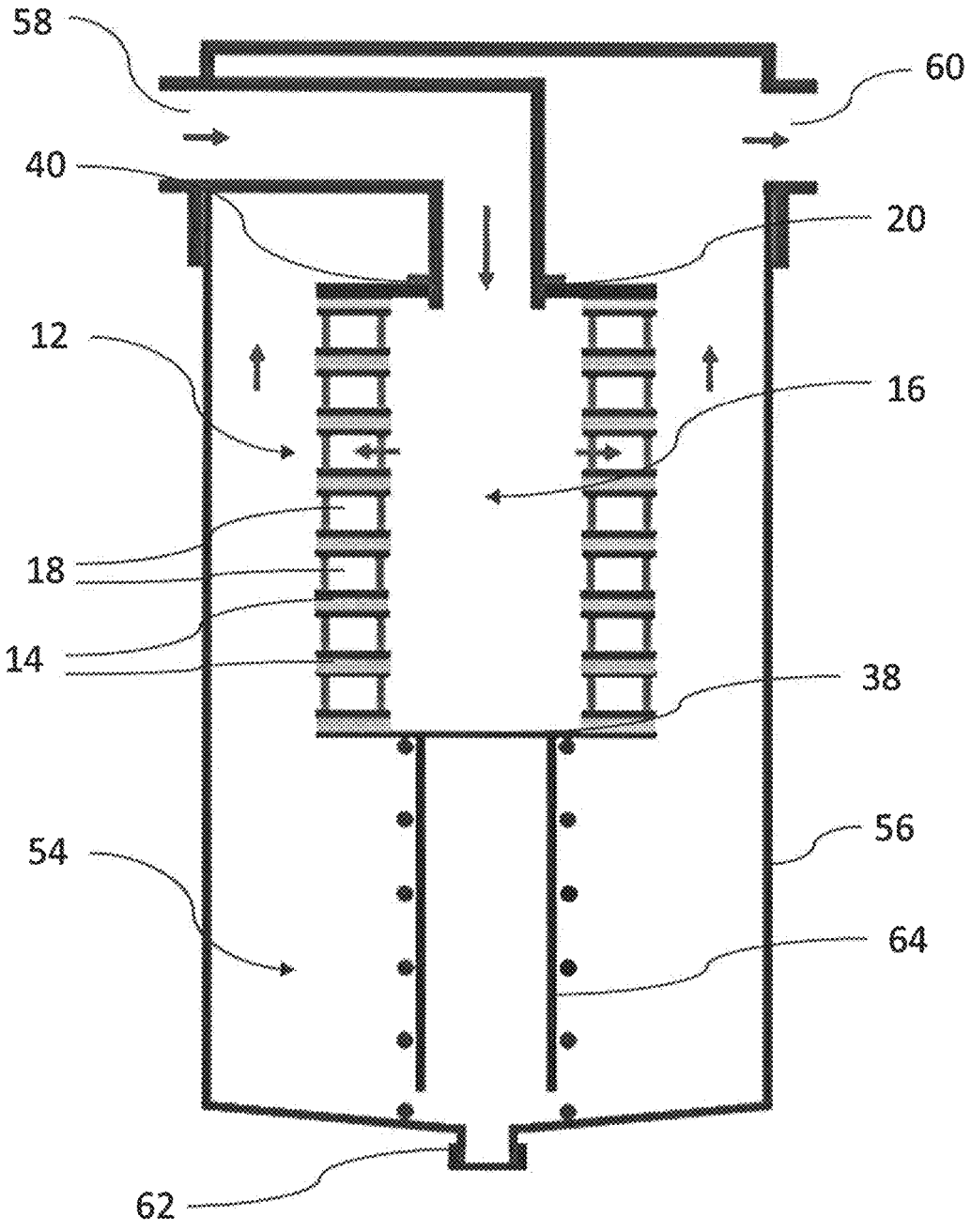
FIG. 10 is a side elevation view in section of a magnetic filter element in context of a retrofit of a conventional filter housing performed by replacing the media filter element.
Figure 12:
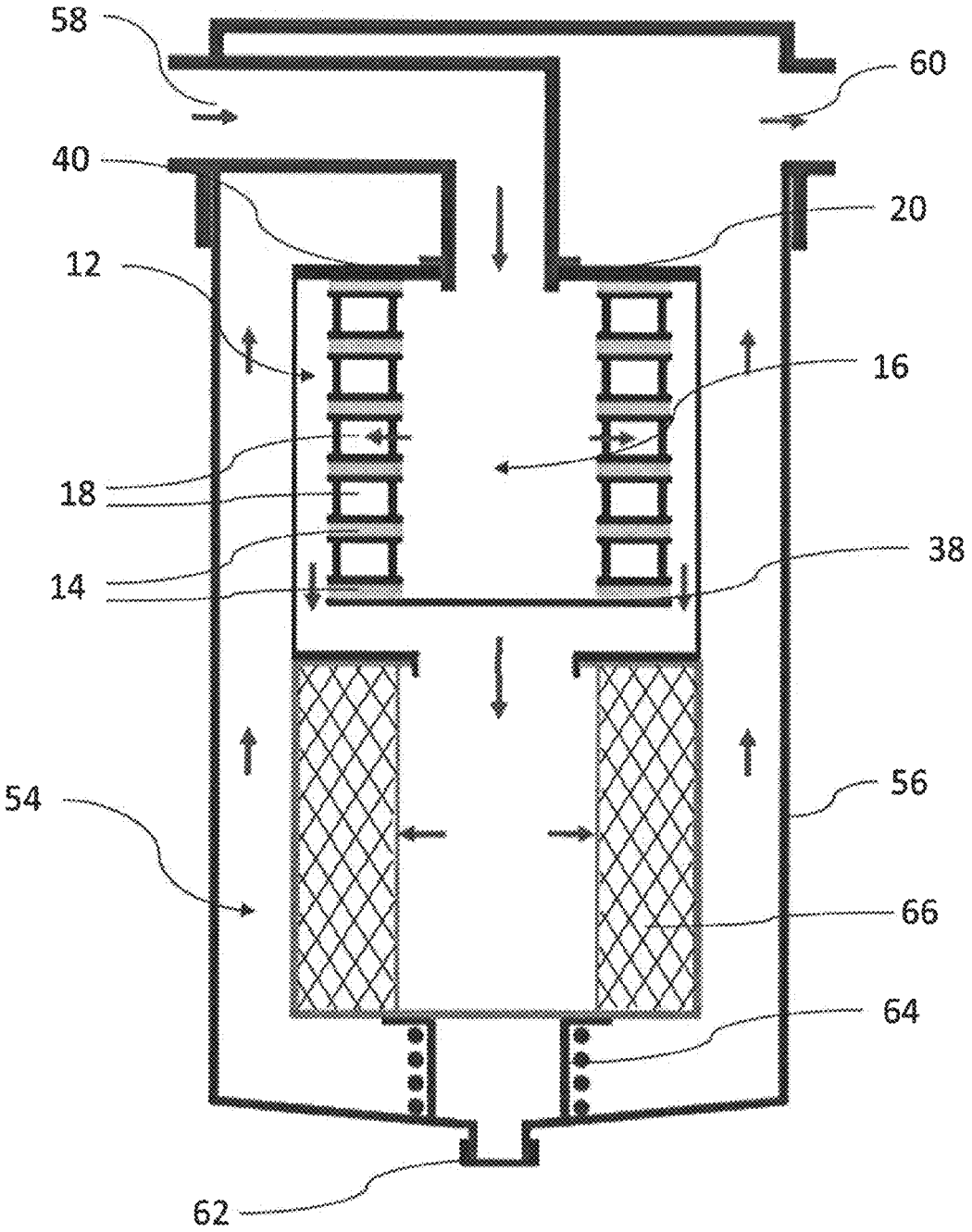
FIG. 12 is a side elevation view in section of a magnetic filter element in a conventional filter housing used in series with a media filter.
Figure 13:
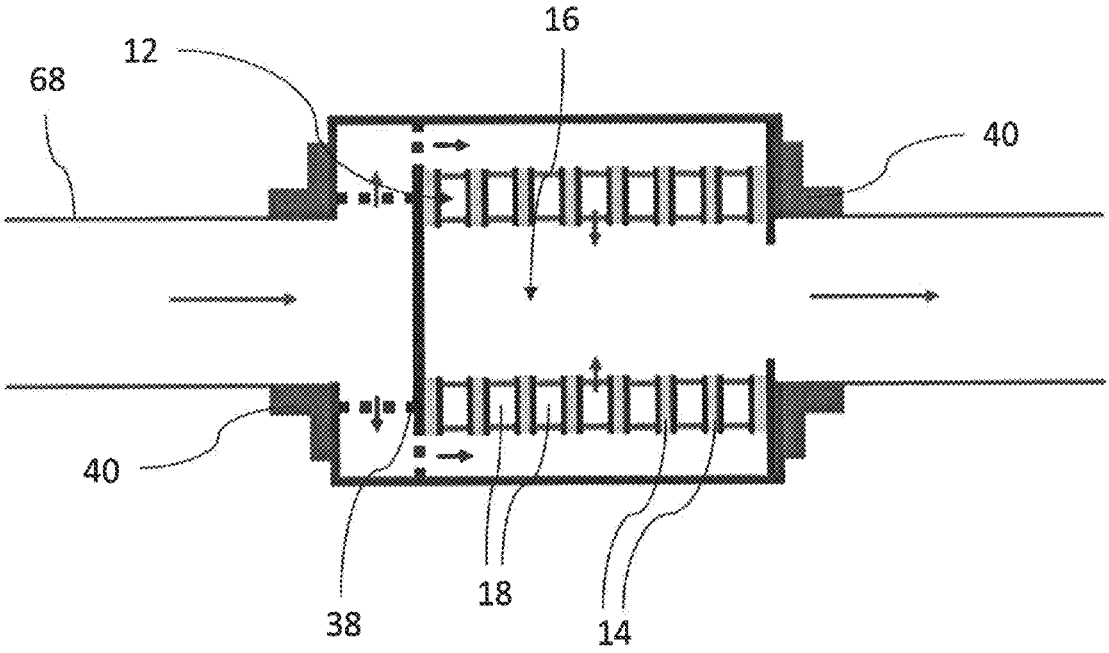
FIG. 13 is a side elevation view in section of a magnetic filter element used in an inline application within a fluid pipe.

FIG. 10 shows the use of stack 12 installed in a conventional filter housing 54. Magnetic filter elements 14 may be used to retrofit an existing media filter and applied to pre-existing filter housings 54 in a variety of contexts. In the depicted embodiment the filter housing 54 has a filter bowl 56, inlet 58, outlet 60, and drain port 62. The stack 12 of magnetic filter elements 14 is attached to a support spring 64. Magnetic filter 10 may also be applied in combination with a traditional media filter 66, as shown in FIG. 12. In this case the fluid being filtered passes through the magnetic filter 10 and then travels through the media filter 66, although it will be understood that these two filters could be used in any order. Magnetic filter 10 may also be applied in an inline pipe application, as shown in FIG. 13. In this case, the magnetic filter 10 is added into pipe 68 and the fluid flows through the stack 12 of magnetic filter elements 14 and then continues on the previous direction of flow through the pipe.

Figure 17:
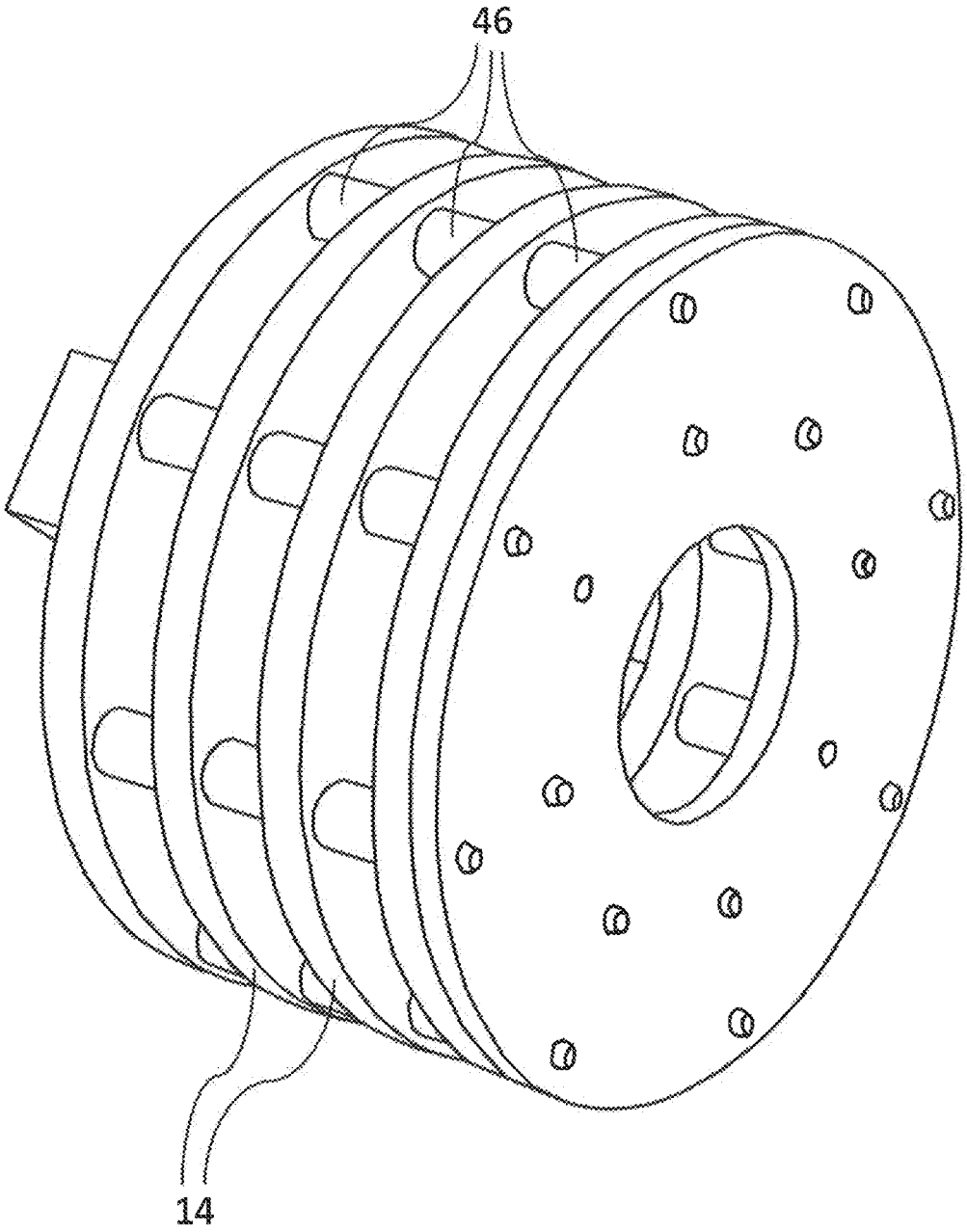
FIG. 17 is a perspective view of a magnetic filter element.

As shown, magnetic filter elements 14 have apertures 44 through which pin connectors 46 are inserted. Spacer elements 48 in the form of elongate cylinders may be placed over pin connectors 46 between filter elements 14 to create and maintain flow gaps 18. Spacer elements 46 are preferably larger than apertures 44 or otherwise maintained between elements 14. Alternatively, spacer elements 46 may be integrally formed with elements 14. As pin connectors 46 are tightened, pressure is increased on spacer elements 46 and filter elements 14, which acts to stabilize magnetic filter 10 and also seal housing 26. While housing 26 may also be closed and sealed using a different approach, using pin connectors 46 has the added benefit of reducing the number of steps to assemble and disassemble magnetic filter 10. While not shown, the height of spacer elements 48 may vary in order to change the size of flow gaps 18 in order to properly proportion the flow along filter element 10 and possibly increase the efficiency of magnetic filter 10. FIG. 17 shows an embodiment of magnetic filter elements 14 connected by pin connectors 46. It will be understood that the geometry and size of the elements in the magnetic filter 10 may vary as discussed previously.

Figure 11:
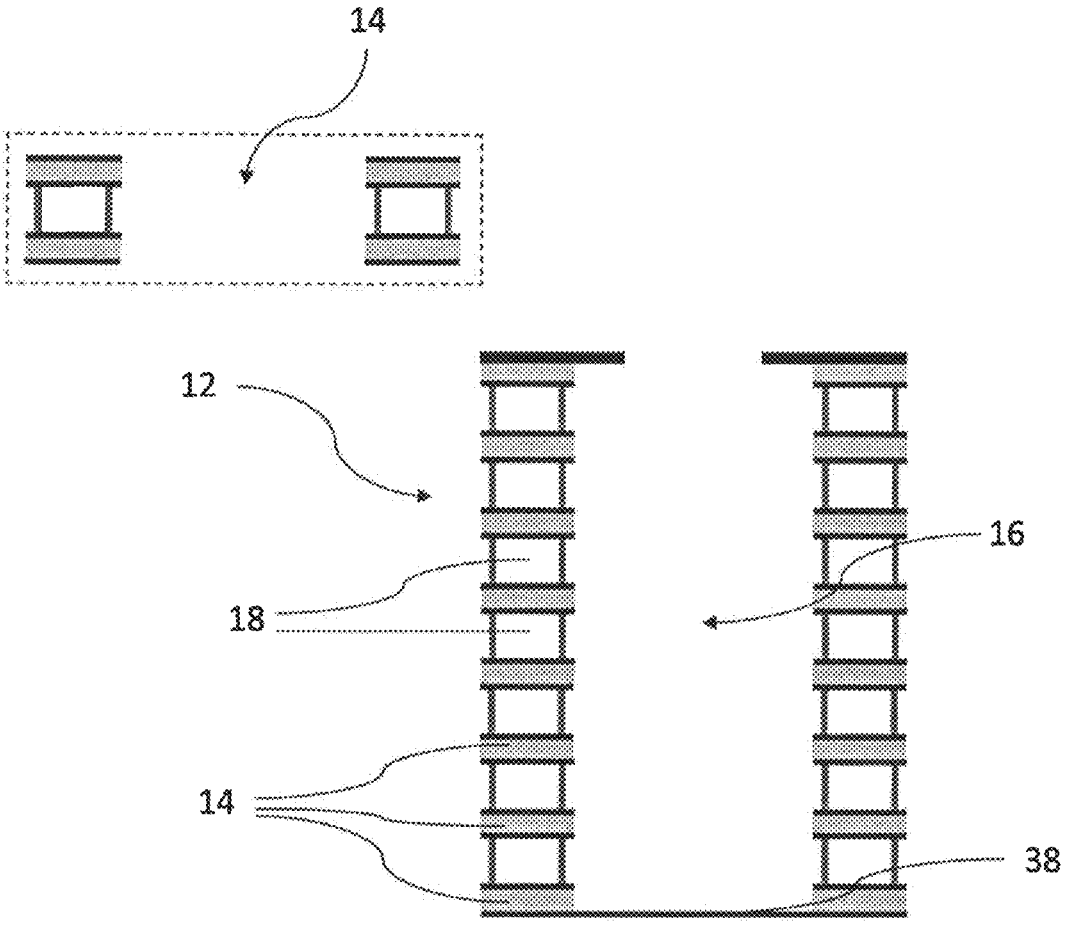
FIG. 11 is a side elevation view in section of a magnetic filter element demonstrating the modular nature of the magnetic filter element. The dashed lines enclose a single modular filter segment.

The number of filter elements 14 in stack 12 may be varied according to the preferences of the user and the design constraints. FIG. 11 depicts an example of the modular nature of the magnetic filter elements 14, allowing for the number used to be varied. The dashed lines in FIG. 11 enclose a single modular filter segment 14 that can be stacked in stack 12. As the number of filter elements increases, the number of flow gaps 18 and therefore the flow cross-sectional area also increases. This increase in flow area results in a reduction of the average velocity and therefore an increase in the dwell time within filter 10. Preferably, the flow areas of gaps 18 and central flow channel 16 are each greater than the flow area of fluid port 20 to prevent any back pressure on the hydraulic system. As depicted in FIG. 1, attachment 40 has a portion that is fitted within fluid port 20. This reduction in flow area at this point may be avoided if necessary by using a different attachment design, or minimized to within an acceptable amount. In addition to increasing the number of filter elements 14 in stack 12, the flow area through gaps 18 may also be increased by increasing the diameter or width of filter elements 14. This may be preferable in situations where the allowable height is limited.

The flow of fluid will now be described with reference to the depicted embodiment in FIG. 1. As mentioned previously, filter 10 may be installed in other environments, although the principles of operation will be similar. Fluid may flow either from fluid port 20 into fluid reservoir 22, or from fluid reservoir 22 into fluid port 20. Magnetic filter 10 is designed to permit parallel flow of fluid through flow gaps 18 between fluid reservoir 22 and central flow channel 16, while end cap 38 prevents the direct flow of fluid along central flow channel 16 and out of filter 10. End cap 38 thus increases the turbulence, causes a change in direction of the fluid flow and enhances the filtering capabilities of filter elements 12. As fluid flows through gaps 18, magnets 24 will act upon the ferrous particles entrained within the flow to magnetically capture them and retain them against filter elements 14. Some magnetic filtering will also occur as fluid passes through central flow channel 16, however it can be seen that the magnetic field will be strongest within flow gaps 18.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed:

1. A magnetic filter comprising:

a stack of magnetic filter elements, the stack having a first end and a second end, each magnetic filter element comprising a non-magnetic housing having an outer perimeter and an inner perimeter that defines a central aperture, the non-magnetic housing enclosing one or more permanent magnets and isolating the one or more magnets from an outer fluid environment, the one or more magnets surrounding the central aperture;

a series of radial flow gaps between adjacent magnetic filter elements;

a central flow channel defined by the central apertures of the magnetic filter elements, an end cap at the second end of the stack of magnetic filter elements, the end cap blocking the central flow channel at the second end of the stack of magnetic filtering elements; and an attachment for attaching the first end of the stack of magnetic filter elements to a fluid port of a fluid system;

wherein the stack of magnetic filter elements and the end cap define a flow path between the fluid port of a fluid system and the outer fluid environment, and the outer fluid environment comprises the central flow channel and the radial flow gaps.

2. The magnetic filter of claim 1, wherein the non-magnetic housing comprises a top plate, a bottom plate, and more than one internal cavity, a magnet being positioned in each internal cavity.

3. The magnetic filter of claim 2, wherein the more than one internal cavity are defined by a spacer element between the top plate and the bottom plate, wherein the top plate, the bottom plate and the spacer element isolate the magnets in each internal cavity.

4. The magnetic filter of claim 1, wherein the magnetic filter elements comprise apertures for receiving pin connectors, wherein the pin connectors are used to assemble the stack of filter elements.

5. The magnetic filter of claim 4, wherein the pin connectors comprise gap spacer elements, the flow gaps between adjacent magnetic filter elements being defined by the gap spacer elements.

6. The magnetic filter of claim 1, wherein the sizes of the flow gaps varies along the stack of magnetic filter elements to equalize the flow rate of the flows through the flow gaps.

7. The magnetic filter of claim 1, wherein the cross-sectional flow area of the flow gaps is greater than the cross-sectional flow area of the fluid port.

8. The magnetic filter of claim 1, wherein the cross-sectional flow area of the central flow channel is greater than the cross-sectional flow area of the fluid port.

9. The magnetic filter of claim 1, wherein the attachment comprises one of a magnetic attachment, a threaded coupling and a pin connection.

10. The magnetic filter of claim 1, wherein the fluid system comprises a filter housing, the stack of magnetic filter elements being disposed within the filter housing such that the outer perimeter of the magnetic filter elements and an inner surface of the filter housing define an outer annulus, the fluid port comprising a first fluid port in communication with the central flow channel and filter the housing comprising a second fluid port in communication with the outer annulus.

11. The magnetic filter of claim 1, wherein the end cap is removably attached to the magnetic filter elements and the magnetic filter elements are modular and connected to each other with removable connections such that the magnetic filter may have variable numbers of layers of flow gaps.

12. The magnetic filter of claim 1, wherein the flow path through the flow gaps is unrestricted.

13. The magnetic filter of claim 1, each permanent magnet comprising a north pole and a south pole, the north and south poles of the magnets being oriented in a direction that is parallel to the central flow path.

14. The magnetic filter of claim 1, wherein the non-magnetic housing encloses a plurality of discrete permanent magnets having a north pole and a south pole and wherein the poles of adjacent magnets alternate.

15. The magnetic filter of claim 1, wherein the one or more permanent magnets have a north pole and a south pole and wherein the one or more magnets in adjacent filter elements are oriented with opposite poles facing across the flow gap.

16. The magnetic filter of claim 1, wherein at least one of an outer perimeter and an inner perimeter of the magnetic filter elements is polygonal.

17. The magnetic filter of claim 1, wherein at least one of an outer perimeter and an inner perimeter of the magnetic filter elements is circular.

18. A method for replacing an existing fluid filter attached to a flow port of a fluid system, the existing fluid filter comprising a filter media across a flow path through the flow port, the method comprising the steps of:

removing the existing fluid filter from the flow port of the fluid system;

attaching a magnetic filter to the fluid flow port to replace the existing fluid filter, the magnetic filter comprising:

a stack of magnetic filter elements, the stack having a first end and a second end, each magnetic filter element comprising a non-magnetic housing having an outer perimeter and an inner perimeter that defines a central aperture, the non-magnetic housing enclosing one or more permanent magnets and isolating the one or more magnets from an outer fluid environment, the one or more magnets surrounding the central aperture;

a series of radial flow gaps between adjacent magnetic filter elements;

a central flow channel defined by the central apertures of the magnetic filter elements, an end cap at the second end of the stack of magnetic filter elements, the end cap blocking the central flow channel at the second end of the stack of magnetic filtering elements; and an attachment for attaching the first end of the stack of magnetic filter elements to a fluid port of a fluid system;

wherein the stack of magnetic filter elements and the end cap define a flow path between the fluid port of a fluid system and the outer fluid environment, and the outer fluid environment comprises the central flow channel and the radial flow gaps.

19. The method of claim 18, wherein the non-magnetic housing comprises a top plate, a bottom plate, and more than one internal cavity, a magnet being positioned in each internal cavity.

20. The method of claim 19, wherein the more than one internal cavity are defined by a spacer element between the top plate and the bottom plate, wherein the top plate, the bottom plate and the spacer element isolate the magnets in each internal cavity.

21. The method of claim 18, wherein the magnetic filter elements comprise apertures for receiving pin connectors, wherein the pin connectors are used to assemble the stack of filter elements.

22. The method of claim 21, wherein the pin connectors comprise gap spacer elements, the flow gaps between adjacent magnetic filter elements being defined by the gap spacer elements.

23. The method of claim 18, wherein the sizes of the flow gaps varies along the stack of magnetic filter elements to equalize the flow rate of the flows through the flow gaps.

24. The method of claim 18 wherein the cross-sectional flow area of the flow gaps is greater than the cross-sectional flow area of the fluid port.

25. The method of claim 18, wherein the cross sectional flow area of the central flow channel is greater than the cross sectional flow area of the fluid port.

26. The method of claim 18, wherein the attachment comprises one of a magnetic attachment, a threaded coupling and a pin connection.

27. The method of claim 18, wherein the fluid system comprises a fluid housing, the stack of magnetic filter elements being disposed within the housing such that the magnetic filter elements and the housing define an outer annulus, the fluid port comprising a first fluid port and the housing comprising a second fluid port in communication with the outer annulus.

28. The method of claim 18, wherein the end cap is removably attached to the magnetic filter element and the magnetic filter elements are modular and connected to each other with removable connections such that the magnetic filter may have variable numbers of layers of flow gaps.

29. The method of claim 18, wherein each permanent magnet comprises a north pole and a south pole, the north and south poles of the magnets being oriented in a direction that is parallel to the central flow path.

30. The method of claim 18, wherein the non-magnetic housing encloses a plurality of discrete permanent magnets having a north pole and a south pole and wherein the poles of adjacent magnets alternate.

31. The method of claim 18, wherein the one or more permanent magnets have a north pole and a south pole and wherein the one or more magnets in adjacent filter elements are oriented with opposite poles facing across the flow gap.

32. The method of claim 18, wherein at least one of the outer perimeter and the inner perimeter of the magnetic filter elements is polygonal.

33. The method of claim 18, wherein at least one of the outer perimeter and the inner perimeter of the magnetic filter elements is circular.

34. The method of claim 18, wherein the magnetic filter is attached in series with a media filter.

* * * * *